US008971155B2

(12) United States Patent
Sano et al.

(10) Patent No.: US 8,971,155 B2
(45) Date of Patent: Mar. 3, 2015

(54) RADIO WAVE TIMEPIECE

(75) Inventors: Takashi Sano, Fussa (JP); Eiji Yamakawa, Tama (JP)

(73) Assignee: Casio Computer Co., Ltd., Tokyo (JP)

( * ) Notice: Subject to any disclaimer, the term of this patent is extended or adjusted under 35 U.S.C. 154(b) by 491 days.

(21) Appl. No.: 13/470,595

(22) Filed: May 14, 2012

(65) Prior Publication Data

US 2012/0294126 A1 Nov. 22, 2012

(30) Foreign Application Priority Data

May 18, 2011 (JP) ..... 2011-111017

(51) Int. Cl.
*G09G 3/28* (2013.01)
*G04R 20/10* (2013.01)

(52) U.S. Cl.
CPC ..... *G04R 20/10* (2013.01)
USPC ..... 368/47; 345/60

(58) Field of Classification Search
USPC ..... 368/47, 46; 345/60
See application file for complete search history.

(56) References Cited

U.S. PATENT DOCUMENTS 5,341,172 A * 8/1994 Nio et al. ..... 348/441
7,307,919 B2 * 12/2007 Fujisawa et al. ..... 368/47
7,321,344 B2 1/2008 Sekii
7,826,566 B2 * 11/2010 Walker et al. ..... 375/340
8,218,691 B2 * 7/2012 Nomura et al. ..... 375/340
2005/0017926 A1 1/2005 Tsuzuki
2007/0152900 A1 * 7/2007 Takada ..... 343/788
2009/0016171 A1 * 1/2009 Fujisawa ..... 368/47

FOREIGN PATENT DOCUMENTS

CN 1577437 A 2/2005
JP 2002-341071 A 11/2002
JP 2004-157233 A 6/2004
JP 2004-333809 A 11/2004
JP 2005-214882 A 8/2005

OTHER PUBLICATIONS

Translated description—JP 2008-215929; Sep. 18, 2008.*
Abstract—JP 2008-215929; Sep. 18, 2008.*
Japanese Office Action dated Apr. 9, 2013 (and English translation thereof) in counterpart Japanese Application No. 2011-111017.
Japanese Office Action dated Jun. 18, 2013 (and English translation thereof) in counterpart Japanese Application No. 2011-111017.
Chinese Office Action dated Feb. 20, 2014 (and English translation thereof) in counterpart Chinese Application No. 201210155113.X.

* cited by examiner

*Primary Examiner* — Sean Kayes
(74) *Attorney, Agent, or Firm* — Holtz, Holtz, Goodman & Chick PC

(57) ABSTRACT

A radio wave timepiece includes: a display unit, a display drive unit, a receiver unit and a control unit. The display unit displays a current time in a digital manner. The display drive unit drives the display unit by a drive signal of a predetermined drive waveform frequency. The receiver unit is capable of receiving radio waves of a plurality of different frequencies including time information. The control unit sets the drive waveform frequency during the reception of a radio wave by the receiver unit so that harmonic frequencies with respect to the drive waveform frequencies can be different from a receiving frequency of the radio wave.

20 Claims, 7 Drawing Sheets

COM WAVEFORM

COM WAVEFORM

COM WAVEFORM

COM WAVEFORM

SEG WAVEFORM

OUTPUT WAVEFORMS

OUTPUT WAVEFORMS

OUTPUT WAVEFORMS

RADIO WAVE TIMEPIECE

BACKGROUND OF THE INVENTION

1. Field of the Invention

The present invention relates to a radio wave timepiece that performs digital display.

2. Description of Related Art

Heretofore, in electronic timepieces, there have been radio wave timepieces which have a function to receive a standard wave including time information expressed in a predetermined format (time code), to obtain time data, and to correct a time of an internal timepiece thereof.

Among the radio wave timepieces having the function as described above, in a digital radio wave timepiece having a digital display function by liquid crystal and the like, electromagnetic noises occur owing to changes of a current and a voltage, which are related to a drive signal for the liquid crystal. The electromagnetic noises are mixed into the standard wave in the event of receiving the standard wave, and deteriorate quality of a demodulated time code signal.

Accordingly, heretofore, in the digital radio wave timepiece, there have been developed: a technology for intermitting drive of the liquid crystal during such reception of the standard wave; and a technology for performing operation control so that timing of sampling the time code signal in a discrete manner and drive timing of the liquid crystal can differ from each other (for example, refer to Japanese Unexamined Patent Application Laid-Open Publication No. 2008-215929).

However, if such a functional restriction that the drive of a digital display unit is stopped during a period of receiving the standard wave is added, then, during the period concerned, a user is forced to be subjected to such an inconvenience that the time cannot be confirmed.

SUMMARY OF THE INVENTION

The present invention provides a radio wave timepiece capable of continuing the drive of the digital display unit during the reception of the standard wave.

According to an aspect of the present invention, there is provided a radio wave timepiece that includes: a display unit to display a current time in a digital manner; a display drive unit to drive the display unit by a drive signal of a predetermined drive waveform frequency; a receiver unit to receive radio waves of a plurality of different frequencies including time information; and a control unit to set the drive waveform frequency during the reception of a radio wave by the receiver unit so that harmonic frequencies with respect to the drive waveform frequencies can be different from a receiving frequency of the radio wave.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

A description of an embodiment of the present invention will be made in detail with reference to the drawings.

Figure 1:
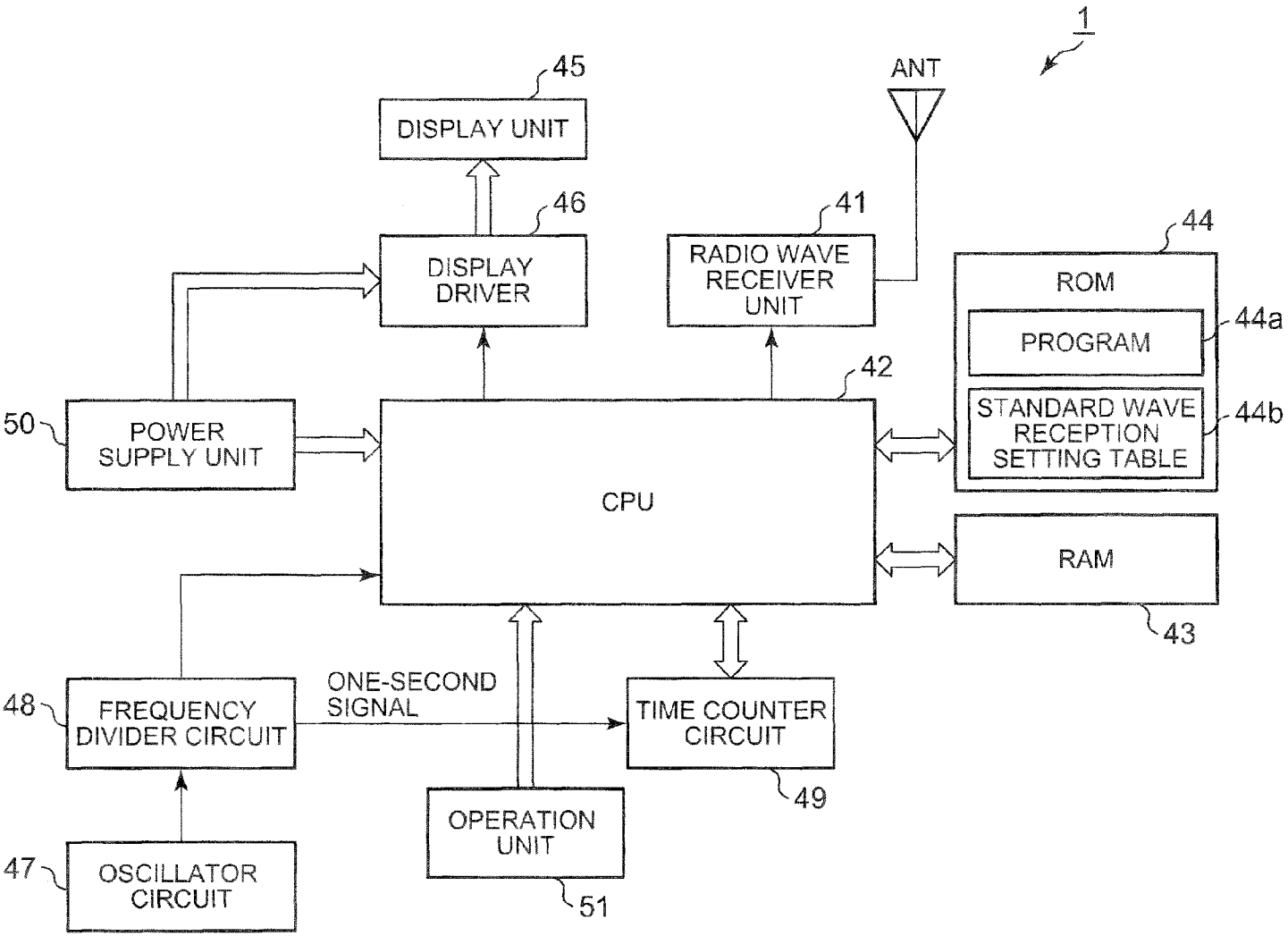
FIG. 1 is a block diagram showing an entire structure of a radio wave timepiece of an embodiment of the present invention.

FIG. 1 is a block diagram showing an entire structure of a radio wave timepiece of an embodiment of the present invention.

The radio wave timepiece 1 of the embodiment of the present invention is a digital radio wave timepiece capable of digital-displaying a time by liquid crystal display. This radio wave timepiece 1 may be a wrist watch or a table clock. Alternatively, the radio wave timepiece 1 may be a digital display device having a function of a radio wave timepiece.

The radio wave timepiece 1 includes: an antenna ANT and a radio wave receiver unit 41, which are as a receiver unit; a CPU 42 (control unit, display control unit); a random access memory (RAM) 43; a read only memory (ROM) 44; a display unit 45; a display driver 46 (display drive unit); an oscillator circuit 47; a frequency divider circuit 48; a time counter circuit 49; a power supply unit 50; an operation unit 51; and the like.

Figure 2:
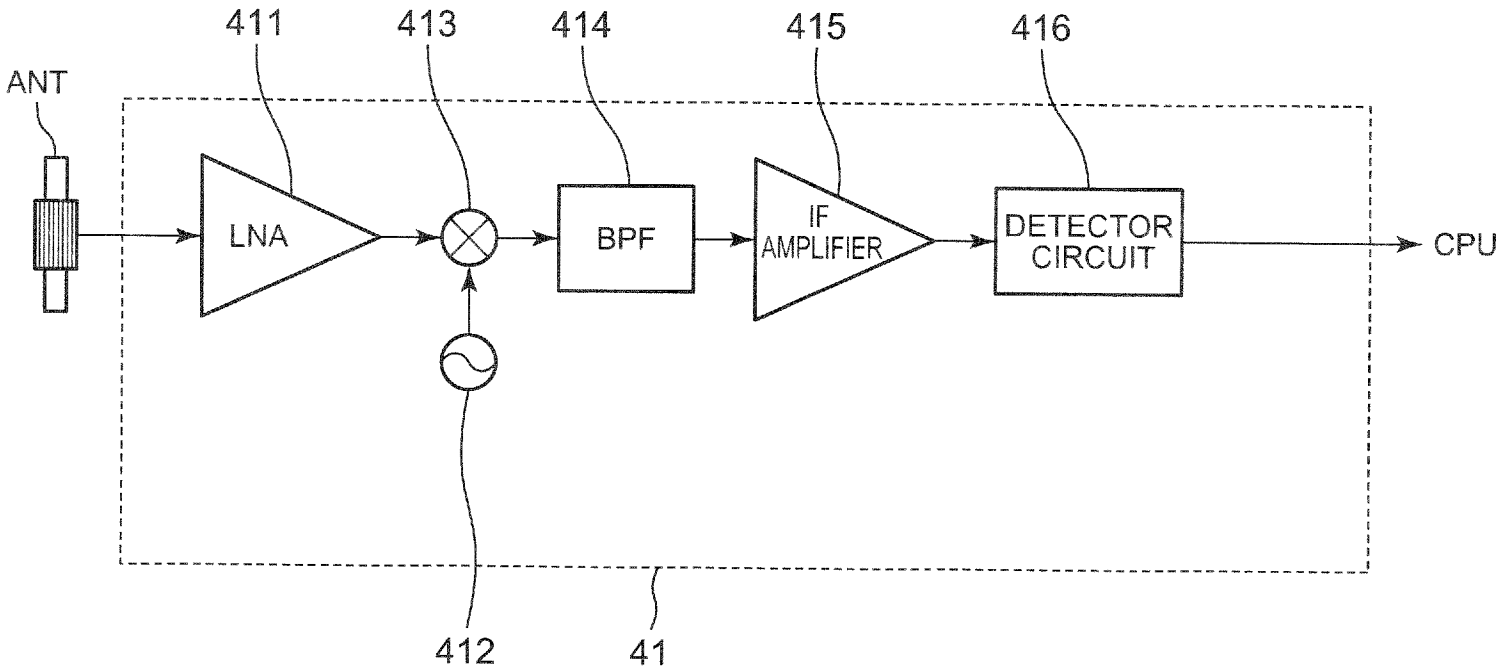
FIG. 2 is a block diagram showing an internal configuration of a radio wave receiver unit.

FIG. 2 is a block diagram showing an internal configuration of the radio wave receiver unit 41.

The radio wave receiver unit 41 includes a receiving circuit that demodulates a time code signal from a standard wave received by using the antenna ANT that receives a radio wave of the long wave band. The standard wave is an amplitude-modulated wave (AM wave) of the long wave band, and in the radio wave receiver unit 41 of this embodiment, the standard wave is demodulated, for example, by a superheterodyne method though a demodulation method is not particularly limited to this. The radio wave receiver unit 41 includes; a low noise amplifier (LNA) 411; a local oscillator 412; a mixer 413; a band pass filter (BPF) 414 (narrow band pass unit); an intermediate frequency (IF) amplifier 415; a detector circuit 416; and the like. The radio wave receiver unit 41 amplifies, by the LNA 411, a received signal as a standard wave corresponding to a tuning frequency of the antenna ANT (for example, the standard wave is a wave of 40 kHz or 60 kHz, which comes from JJY as a standard wave transmitting station of Japan), converts the received signal into a signal of an intermediate frequency, and thereafter, in the BPF 414, allows a signal within a predetermined frequency range (for example, a range of approximately ±10 Hz) to selectively pass therethrough. Then, an output signal of the BPF 414 is amplified by the IF amplifier 415, and thereafter, the time code signal is demodulated by the detector circuit 416. This radio wave receiver unit 41 has a configuration in which a power supply is turned on according to an instruction from the CPU 42 only in the event of receiving the standard wave. Moreover, it is made possible to change the tuning frequency of the antenna ANT by finely adjusting a setting of a tuned circuit in the radio wave receiver unit 41.

Moreover, this radio wave receiver unit 41 further includes an analog/digital converter (ADC) (not shown), digital-binarizes the demodulated time code signal at a predetermined sampling frequency, and outputs the time code signal as a time code output (TCO) to the CPU 42.

Note that multiple data may be outputted depending on a method of decoding time data from the time code signal in the CPU 42. Moreover, an analog signal may be directly binarized by using a comparator. Furthermore, an output as the TCO is not particularly limited; however, the TCO is configured so as to become a low-level voltage signal in the case of being larger than a predetermined threshold voltage set in the ADC, and to become a high-level voltage signal in the case of being smaller than this threshold voltage.

The CPU 42 controls and manages the entire operation of the radio wave timepiece 1. Moreover, upon receiving the TCO from the radio wave receiver unit 41, the CPU 42 decodes and obtains the time data from this time code. As a decoding method of the time data and an enhancement method of sensitivity at the time of decoding the time data, various conventional technologies are usable. Moreover, the CPU 42 sends a signal to the time counter circuit 49 based on the obtained time data, and corrects current time data held by the time counter circuit 49.

The RAM 43 provides a working memory space to the CPU 42. Moreover, the RAM 43 stores setting data regarding a reception time of the standard wave and the standard wave transmitting station from which the reception is attempted.

In the ROM 44, there are stored: a variety of programs for allowing the radio wave timepiece 1 to perform various operations; and initial setting data. In the programs stored in the ROM 44, a program 44*a* for receiving the standard wave and correcting the timepiece is included. When execution of the program 44*a* is instructed based on a set time stored in the RAM 43 or on an operation input from the operation unit 51, the CPU 42 expands the program 44*a* on the RAM 43, and executes the same. Moreover, in the ROM 44, a standard wave reception setting table 44*b* (storage unit) is included, in which, in association with one another, there are stored: transmission frequencies of such standard wave transmitting stations located all over the world, from which the radio wave timepiece 1 is capable of receiving signals; formats of the time code; respective symbol patterns; and frame frequencies at which the display unit 45 is driven during periods while the radio waves from the standard wave transmitting stations are being received.

The display unit 45 has a configuration capable of digital-displaying the time data, and for example, is a liquid crystal display (LCD) capable of segment-displaying numbers and letters. The display unit 45 may be a display according to another mode, for example, a display according to a dot matrix mode, or may be an organic electro luminescent (EL) display.

The display driver 46 is an LCD driver that outputs a voltage signal for displaying the time and other information on the LCD as the display unit 45 based on a control signal from the CPU 42. In the display driver 46, there are stored in advance: a predetermined number (for example, four) of common (COM) voltage signal waveforms; and a predetermined number (for example, eight) of segment (SEG) voltage signal waveforms. The respective segments of the display unit 45 are individually controlled to be turned on and turned off by potential differences between the COM voltages and the SEG voltages in such a manner that the COM voltage signal waveforms and the SEG voltage signal waveform selectively outputted by the display unit 45 are combined with each other.

For example, the oscillator circuit 47 outputs an oscillation signal of 32 kHz. The frequency divider circuit 48 frequency-divides this oscillation signal, and creates and outputs frequency signals necessary for operations of the respective units such as the CPU 42 in the radio wave timepiece 1. Among the frequency signals outputted from the frequency divider circuit 48, a 1 Hz signal is inputted to the timer counter circuit 49 and is used for counting the current time. Moreover, the frequency divider circuit 48 is made capable of appropriately switching a frequency division ratio and outputting signals of different frequencies in accordance with an instruction from the CPU 42.

The time counter circuit 49 is a counter. The time counter circuit 49 counts signals inputted every second from the frequency divider circuit 48, and sequentially adds the counted signals to an initially set time, thereby counting the current time. Moreover, it is made possible to correct the current time data, which is stored in this time counter circuit 49, in accordance with a control command from the CPU 42.

The power supply unit 50 supplies a drive voltage to the CPU 42, and in addition, supplies the respective voltages, which are necessary to drive the display unit 45, to the display driver 46. For example, in order to drive the display unit 45 with a ⅓ bias (B), the power supply unit 50 supplies a ground voltage (V0) and three types of drive voltages (V3, V2=V3×⅔, V1=V3×⅓) to the display driver 46.

The operation unit 51 includes pluralities of keys and buttons. When these keys and buttons are operated, the operation unit 51 converts contents of the operations into electrical signals, and outputs the electrical signals as input signals to the CPU 42.

Next, a description is made of such turn-on control for the respective segments of the display unit 45.

FIGS. 3A to 3D are charts showing examples of four types of COM voltage signal waveforms set in the display driver 46.

Figure 3A:
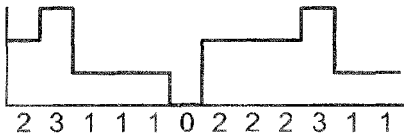
FIGS. 3A to 3D are charts showing examples of COM waveforms stored in a display driver.
Figure 3B:
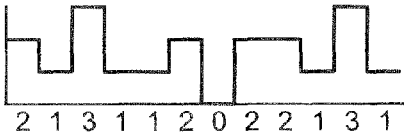
Figure 3C:
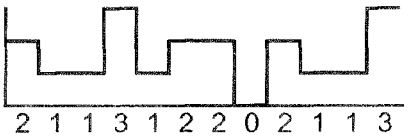
Figure 3D:
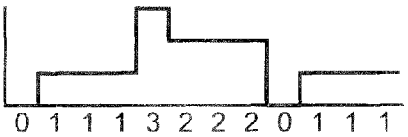
Figure 3E:
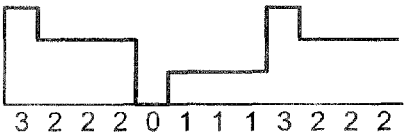
FIG. 3E is a chart showing an example of a SEG waveform.

FIG. 3E is a chart showing an example of a one pattern among the SEG voltage signal waveforms. FIGS. 3F to 3I are charts showing examples of output voltage signal waveforms in which these COM voltage signal waveforms and the SEG voltage signal waveform are combined with each other. Numbers 0 to 3 written under the respective charts denote numeric value portions of the voltage values V0 to V3 at the respective pieces of timing shown on an axis of abscissas. In a usual state, the display driver 46 of this embodiment outputs the COM voltage signal waveforms and the SEG voltage signal waveform, in each of which a duty (D) is ¼, at a frame frequency f1=100 Hz (frame period: 10 ms). In the output voltage signal waveforms, waveforms in this frame period and waveforms in which the waveforms concerned are inverted in polarity appear continuously. Accordingly, as shown in FIGS. 3F to 3I, the output voltage signal waveforms become periodic signals of 50 Hz as a half of the frame frequency f1, and the display unit 45 is driven at this frequency (drive waveform frequency).

Figure 3F:
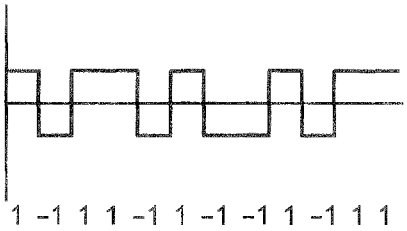
FIG. 3F to FIG. 3I are charts showing examples of output waveforms in which the COM waveforms and the SEG waveform are combined with each other.
Figure 3G:
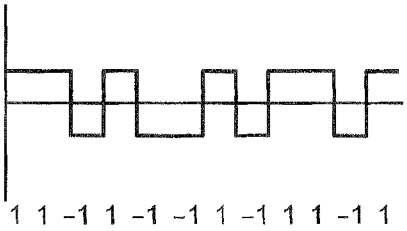
Figure 3H:
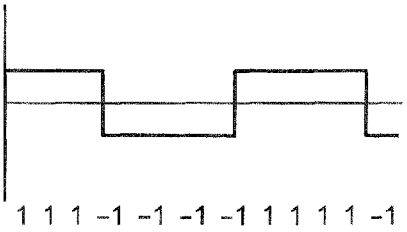
Figure 3I:
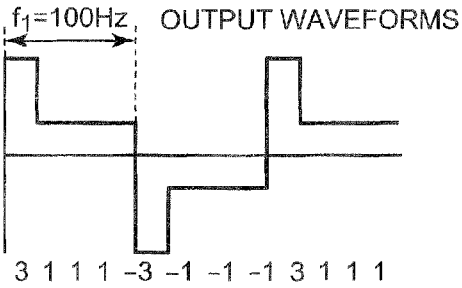

Here, as shown in the output voltage signal waveforms of FIGS. 3F to 3H, in the combinations of the COM voltage signal waveforms of FIGS. 3A to 3C and the SEG voltage signal waveform, only positive and negative voltages V1 are outputted, and all of segments to which the voltages concerned are supplied turn to a turn-off state. Meanwhile, as shown in the output voltage signal waveform of FIG. 3I, in the combination of the COM voltage signal waveform of FIG. 3D and the SEG voltage signal waveform of FIG. 3E, positive and negative voltages V3 are outputted at predetermined timing in a frame period, and a segment to which the voltages concerned are supplied is turned on. A plurality of the SEG voltage signal waveforms are set and stored in the display driver 46 so that it can become possible to turn on arbitrary zero to four segments by the combinations of the SEG voltage signal waveform with the COM voltage signal waveforms of FIGS. 3A to 3D as described above. Then, the SEG voltage signal waveform is selected based on the control signal from the CPU 42, whereby it becomes possible to control turn-on states and turn-off states of the four segments. Moreover, the plurality of SEG voltage signal waveforms are selected and outputted simultaneously, whereby a larger number of the segments can be controlled to be turned on and turned off.

Next, a description is made of electromagnetic noises to be caused by the output of the voltage signal waveform.

Figure 4A:
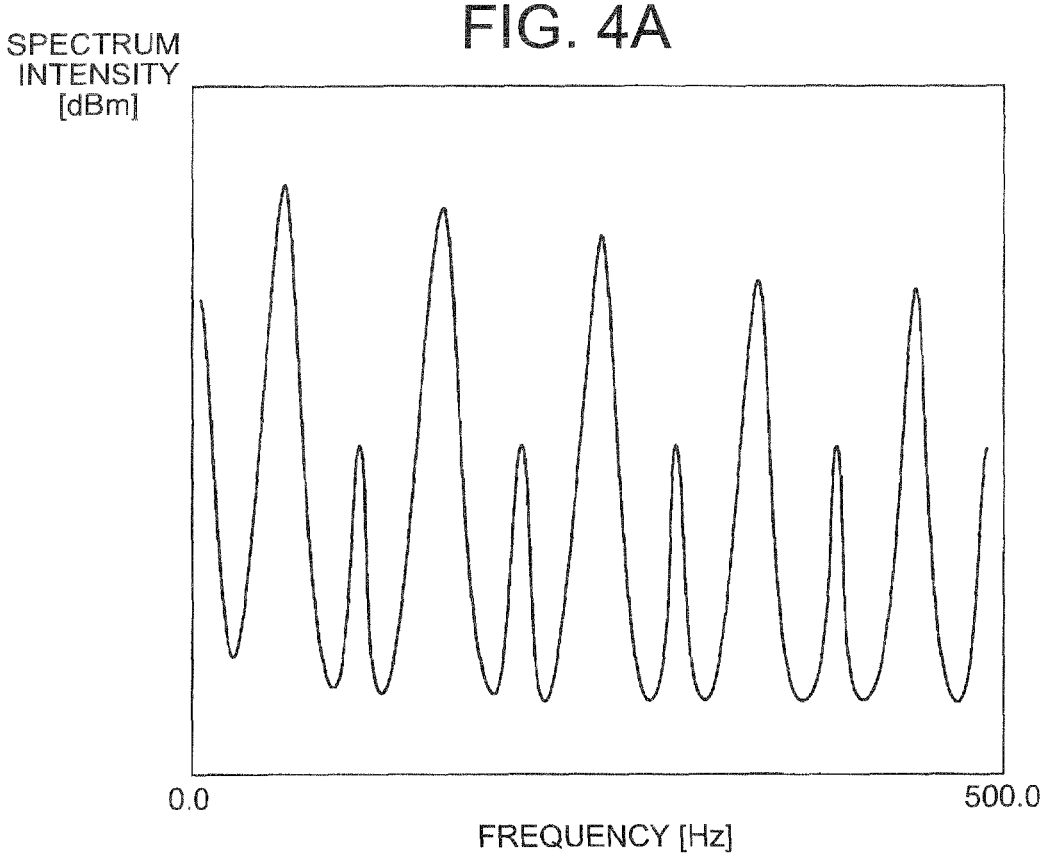
FIGS. 4A and 4B are diagrams showing spectrums of noises which occur in an event where a display unit is driven by the display driver.
Figure 4B:
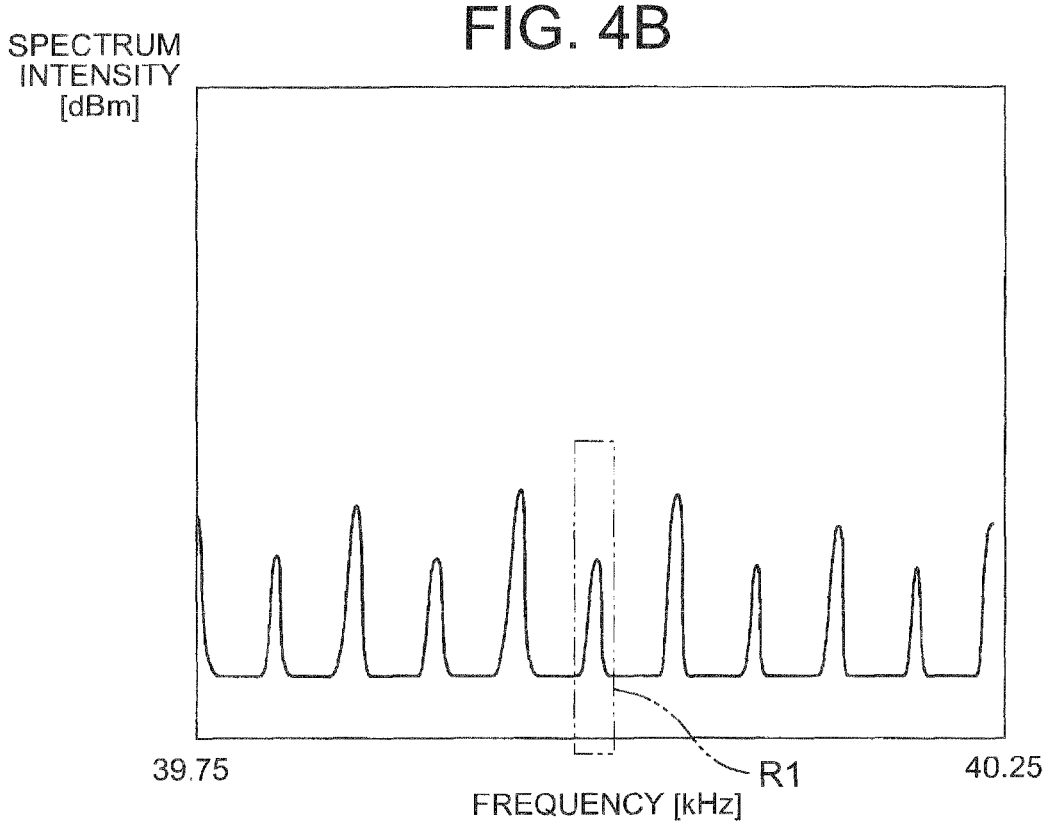

FIG. 4A and FIG. 4B are diagrams showing spectrums of electromagnetic noise intensities which occur in an event where the display unit 45 is driven by the display driver 46. FIG. 4A shows spectrum intensities of the electromagnetic noises from 0 Hz (direct current component) to 500 Hz. Moreover, FIG. 4B shows spectrum intensities of the electromagnetic noises from 39.75 kHz to 40.25 kHz.

Electromagnetic noises which occur by a rectangular voltage signal with a frame frequency f1=100 Hz, that is, a drive waveform frequency of 50 Hz appear on frequencies integer times 50 Hz. Among such electromagnetic noises at the respective frequencies, those within a receiving frequency range by the antenna ANT are received together with the standard wave.

At this time, as shown in FIG. 4B, in the case where such occurrence frequencies of the electromagnetic noises are included in a pass frequency band R1 of the BPF 414, the electromagnetic noises are superimposed on the time code signal, and receiving sensitivity (C/N) ratio is lowered. Meanwhile, 50 Hz as a frequency interval of harmonics of electromagnetic pulses is wide enough in comparison with approximately 10 Hz as the pass frequency band R1 of the BPF 414. Hence, a case is possible where the occurrence frequencies of the electromagnetic noises are not included in the pass frequency band R1 of the BPF 414. The electromagnetic noises at this time are cut by the BPF 414, and do not affect the receiver sensitivity for the time code signal.

Accordingly, in the radio wave timepiece 1 of this embodiment, the frame frequency is appropriately changed at the time of receiving the standard wave, whereby all of the occurrence frequencies of the electromagnetic noises are made to go out of the pass frequency band R1 by the BPF 414. That is to say, in response to the receiving frequency of the standard wave, the frame frequency is set so that the occurrence frequencies of the electromagnetic noises cannot be superimposed on the pass frequency band R1 of the BPF 414.

Figure 5A:
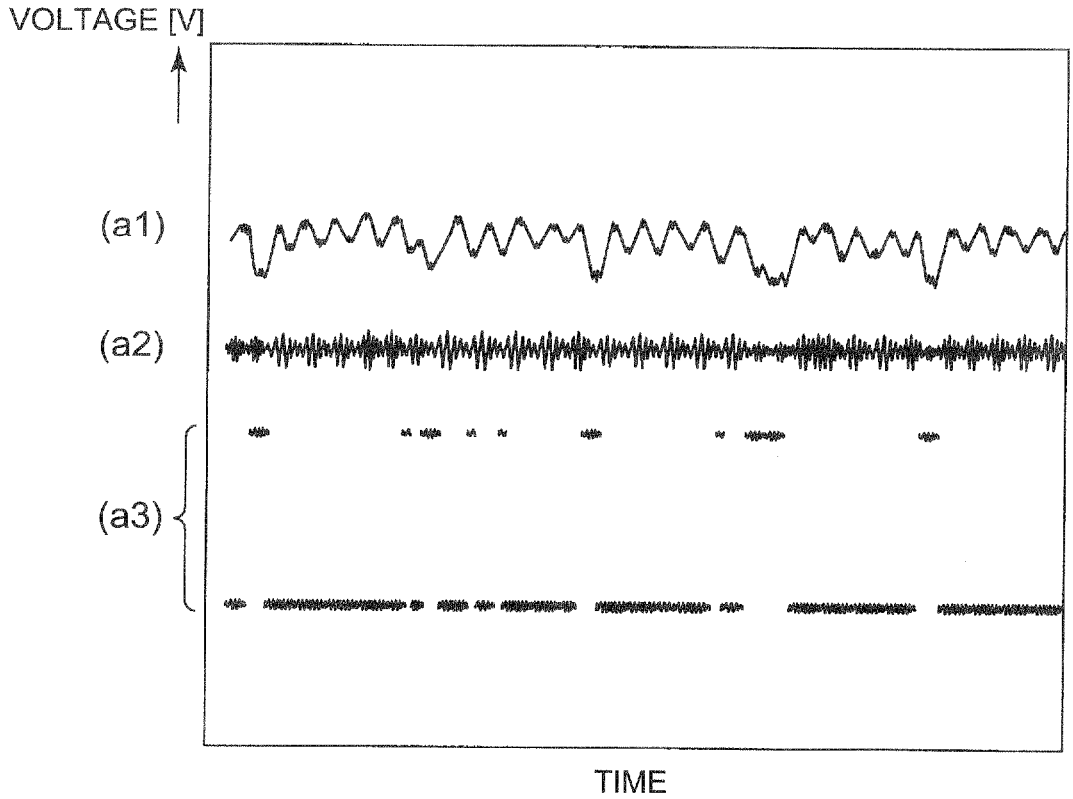
FIGS. 5A and 5B are diagrams individually showing waveforms of signals received by the radio wave receiver unit, demodulated signals, and TCOs.
Figure 5B:
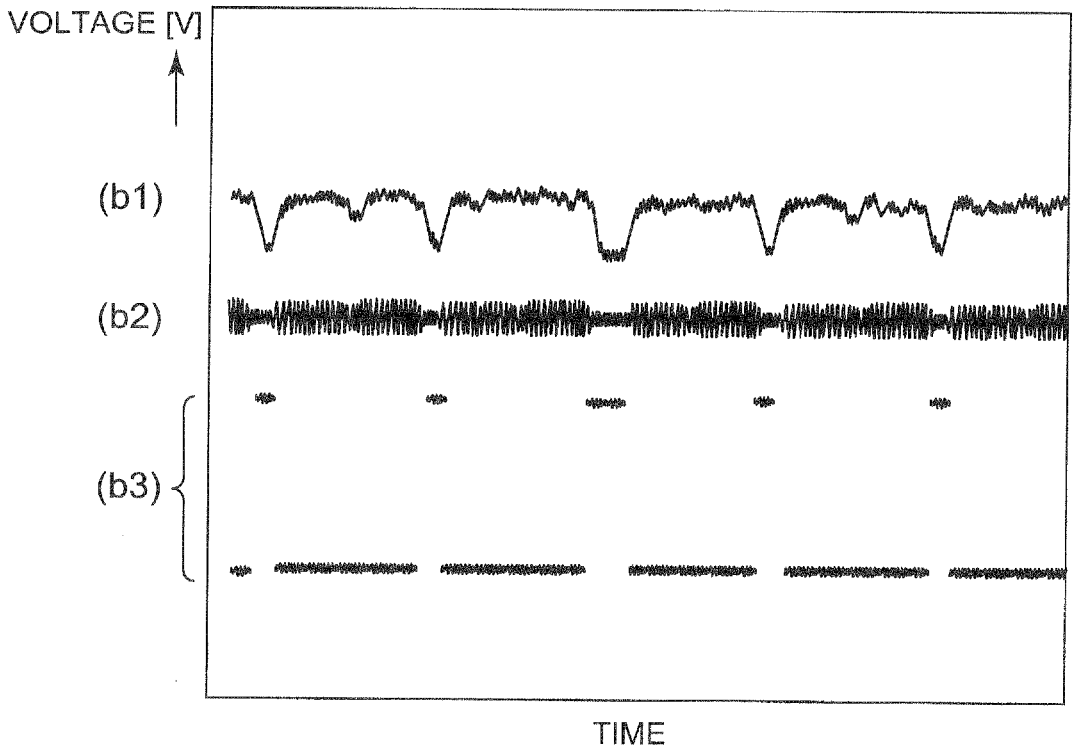

FIGS. 5A and 5B are diagrams individually showing voltage waveforms of output signals of the BPF 414, the demodulated signals and the TCOs in the event of receiving the standard wave of 40 kHz by the radio wave receiver unit 41. FIG. 5A shows such signals in the case where the electromagnetic noises are included in the pass frequency band R1 of the BPF 414. Moreover, FIG. 5B shows such signals in the case where the electromagnetic noises are not included in the pass frequency band R1 of the BPF 414.

In the case where the electromagnetic noises are included in the pass frequency band R1 of the BPF 414, noise components are mixed into the output signal (a2) of the BPF 414, the demodulated signal (a1) and the TCO (a3). Here, in the frame frequency of a liquid crystal drive signal as a generation source of the electromagnetic noises, it is possible that small frequency errors and fractions may be included owing to output accuracy of the oscillation signal of 32 kHz, which is outputted from the oscillation circuit 47, setting of the frequency divider circuit 48, and the like. Hence, as shown in FIG. 5A, the harmonic frequency of the drive waveform frequency and the receiving frequency of the standard wave do not coincide with each other completely, and a shift is present therebetween, whereby a beat occurs in the demodulated signal (a1). During a period while the voltage of the demodulated signal is being lowered owing to variations of the signal intensity, which are caused by this beat, the TCO (a3) is often converted to a high level by mistake, followed by output.

Meanwhile, as shown in FIG. 5B, in the case where the electromagnetic noises are not included in the pass frequency band R1 of the BPF 414, the components of the electromagnetic noises are not included in the output signal (b2) of the BPF 414 and the demodulated signal (b1). Hence, the TCO (b3) that is correct is obtained and outputted.

Here, in the actual voltage waveform, finite rise time and drop time are included in such a rectangular wave, whereby, as shown in FIG. 5A and FIG. 5B, a pulse width is present at a peak of each of the spectrum intensities. Hence, the frame frequency is set so that a center frequency of the pass frequency band R1 and an intermediate value between occurrence frequencies of two electromagnetic noises which are adjacent to or side by side with the pass frequency band R1 in both the upper side and the lower side can be equal to each other, whereby an influence of the electromagnetic noises can be suppressed most effectively.

Moreover, an interval between the occurrence frequencies of the electromagnetic noises is widened as the frame frequencies become larger. Hence, the frame frequencies are raised, whereby the occurrence frequencies of the electromagnetic noises can be spaced more apart from the pass frequency band R1. Meanwhile, as the frame frequencies are rising, power consumption is increased. In consideration of these advantages and disadvantages, a rise range of the frame frequencies at the time of receiving the standard wave is set as appropriate. According to the instruction from the CPU 42, the setting of the frequency division ratio in the frequency divider circuit 48 is changed, and frame frequency signals thus changed are outputted, and are inputted to the display driver 46.

Moreover, the following configuration may also be adopted. To the display driver 46, high frequency signals are inputted from the frequency divider circuit 48, and the display driver 46 counts the high frequency signals, thereby counts desired frame period lengths, and controls the output of the SEG voltage signal waveform. Furthermore, the following configuration may also be adopted. The CPU 42 counts the high frequency signals outputted from the frequency divider circuit 48, and sends period signals to the display driver 46 for each of the desired frame period lengths.

Note that, desirably, the frame frequencies at the time of receiving the standard wave are set so that harmonic frequencies thereof can have values different not only from that of the pass frequency band R1 of the BPF 414 but also from those of an image frequency and a spurious frequency of the local oscillator.

Next, a description is made of an operation procedure when the standard wave is received in the radio wave timepiece 1 of this embodiment.

Figure 6:
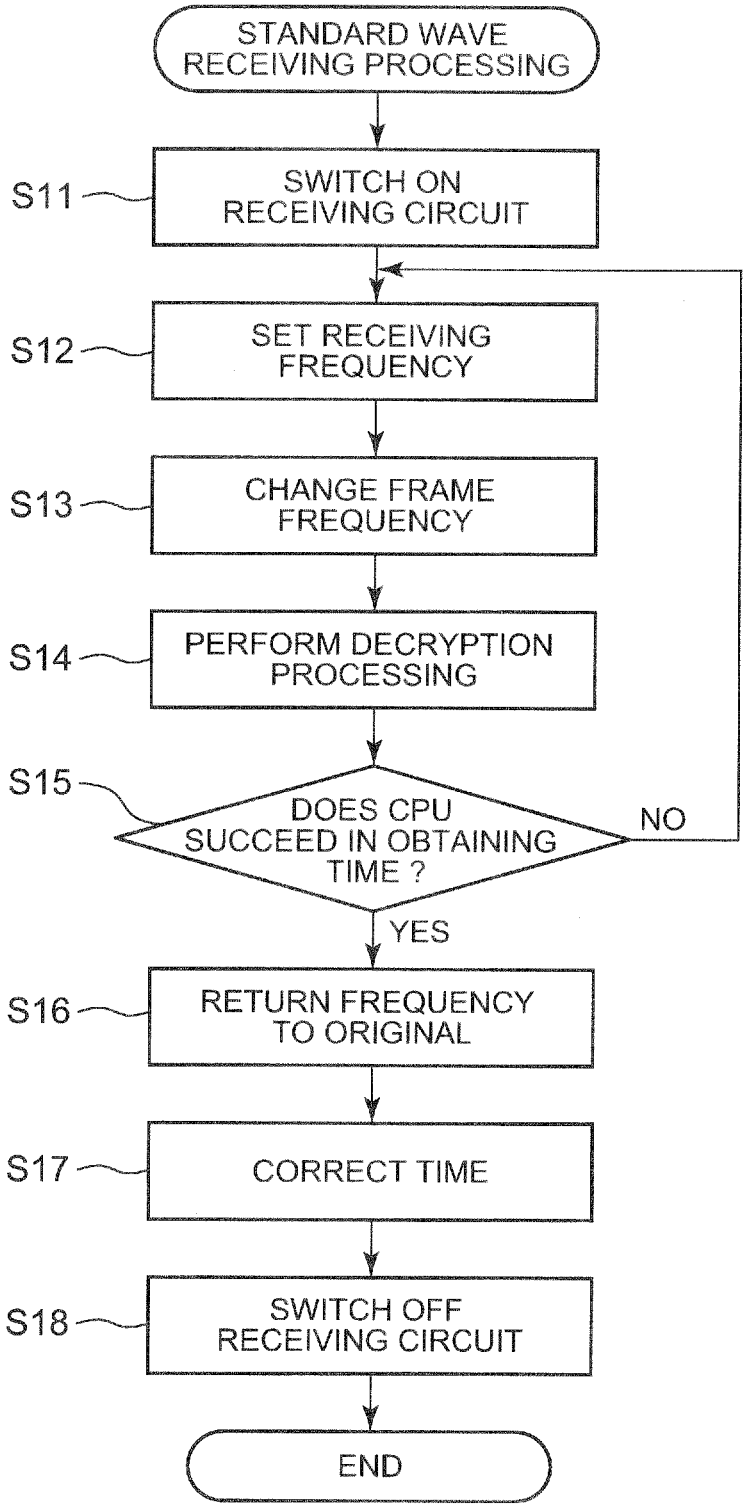
FIG. 6 is a flowchart showing a procedure of control operations which a CPU executes in an event of performing standard wave receiving processing.

FIG. 6 is a flowchart showing a procedure of control operations which the CPU 42 executes in the event of performing standard wave receiving processing.

In the case where the current time counted by the time counter circuit 49 reaches a preset time, or in the case where an execution command of the standard wave receiving processing is inputted by operation input to the operation unit 51 by the user, this standard wave receiving processing is executed after the program 44*a* is read out from the ROM 44 and is expanded in the RAM 43.

When the standard wave receiving processing is started, the CPU 42 first switches on the radio wave receiver unit 41 (Step S11). Subsequently, the CPU 42 changes the setting of the tuned circuit according to needs and sets the receiving frequency of the standard wave based on setting information stored in the RAM 43 (Step S12). For example, this setting information is city information inputted by the user operation, and information of the standard wave transmitting station, which is received in the event of the previous standard wave receiving processing.

Next, the CPU 42 reads the standard wave reception setting table 44*b* stored in the ROM 44 in association with the set receiving frequencies, and changes the frame frequencies related to the output signals of the display driver 46 that drives the display unit 45 (Step S13). With regard to the frame frequencies thus already changed, any of harmonic frequencies as halves thereof does not have a value included in the pass frequency band R1 of the BPF 414 in the radio wave receiver unit 41. The CPU 42 executes decryption processing for the time data by using the TCO inputted from the radio wave receiver unit 41 (Step S14). Specifically, the CPU 42 decodes the time code to obtain values of the date and hour/minute/second, and in addition, determines a second synchronization point that indicates timing of the head of every second.

Then, the CPU 42 determines whether or not to succeed in obtaining the time data (Step S15). In the case where the CPU 42 determines to fail to obtain the time data (Step S15; NO), the processing of the CPU 42 returns to Step S12, and the CPU 42 changes the receiving frequency to another a frequency of another standard wave, and repeats the respective pieces of processing for obtaining the time (Steps S12 to S15).

In the determination processing of Step S15, in the case where the CPU 42 determines to succeed in obtaining the time data (Step S15; YES), the CPU 42 returns the frame frequencies of the drive signals for the display unit 45, which are outputted from the display driver 46, to the original values (Step S16). Moreover, the CPU 42 corrects the time data of the time counter circuit 49 based on the obtained time data (Step S17), and turns off the radio wave receiver unit 41 (Step S18). Then, the CPU 42 ends the standard wave receiving processing.

Note that, in the above-described standard wave receiving processing, the processing is repeated while changing the receiving frequency until the obtainment of the time is succeeded; however, in the case where the obtainment of the time is not succeeded at the point of time when all of the standard waves of the receiving frequencies set and registered in the ROM 44 are received, then the correction of the time is not performed, and the standard wave receiving processing is ended at that point of time.

Figure 7A:
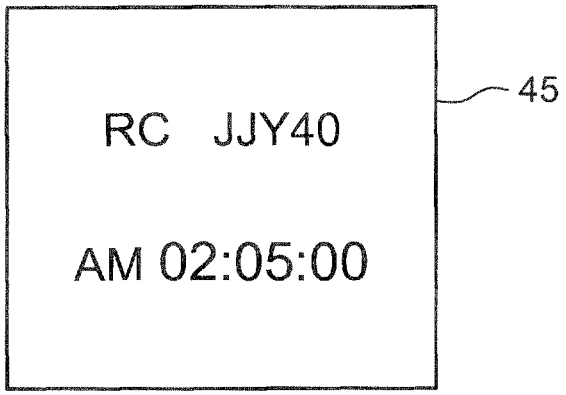
FIGS. 7A and 7B show display examples to the display unit during the standard wave receiving processing.
Figure 7B:
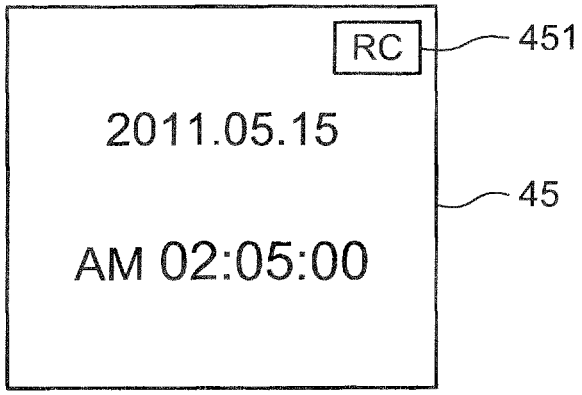

FIGS. 7A and 7B show display examples to the display unit during the standard wave receiving processing.

In the radio wave timepiece 1 of this embodiment, it is possible to allow the display unit 45 to perform the continuous display even during the standard wave receiving processing. For example, as shown in FIG. 7A, during the standard wave receiving processing, the display unit 45 may be allowed to display "RC" (radio control) indicating that the standard wave receiving processing concerned is under execution, and in addition, to display the standard wave transmitting station from which the standard wave is being received, and the receiving frequency (for example, the station JJY, 40 kHz). Alternatively, as shown in FIG. 7B, the display unit 45 may be allowed to display the usual display of the date and time continuously, and to display a mark 451 "RC" indicating that the standard wave is under receiving processing.

As described above, the radio wave timepiece 1 of this embodiment includes: the display unit 45 capable of digital-displaying the current time by the LCD and the like; the display driver 46 that drives this display unit 45 by the drive signal of the drive waveform frequency, which is based on the frame frequency set based on the control command from the CPU 42; and the antenna ANT and the radio wave receiver unit 41, which receive the standard wave in tune with the receiving frequency of the standard wave. Then, in the event where the radio wave receiver unit 41 is tuned with the receiving frequency of the standard wave in order to receive the standard wave, the drive waveform frequency is set so that such a tuned frequency of this radio wave receiver unit 41 and the harmonic frequency of the drive waveform frequency of the display unit 45 by the display driver 46 can have values different from each other. In such a way, there can be reduced an adverse effect to the receiver sensitivity of the standard wave, which is caused by the matter that the electromagnetic noise caused by driving the display unit 45 is received by the radio wave receiver unit 41.

Moreover, in this radio wave timepiece 1, during the reception of the standard wave by the radio wave receiver unit 41, the receiving frequency of the standard wave as a reception subject is set so as to be equal to an intermediate value between two frequencies adjacent to or side by side with each other among the harmonic frequencies with respect to the drive waveform frequency of the display unit 45 by the display driver 46. Hence, the frequencies of the electromagnetic noises are spaced farthest from the standard wave as the reception subject, whereby the effect of the electromagnetic noises received by the radio wave receiver unit 41 can be reduced.

Moreover, in the radio wave receiver unit 41, the BPF 414 is provided, which allows the signal to selectively pass therethrough, the signal being within the frequency range narrower than the frequency interval in the harmonics of the drive waveform frequency. At the time when the standard wave is received by the radio wave receiver unit 41, the frame frequency, that is, the drive waveform frequency is set so that the harmonic frequencies of the drive waveform frequency of the display unit 45 by the display driver 46 cannot enter the pass frequency band R1 of the BPF 414. Hence, the electromagnetic noises caused by the drive signal in the event where the display unit 45 is driven are cut by the BPF 414, and the receiving sensitivity in the event of decoding the time code from the standard wave can be maintained.

Moreover, in this radio wave timepiece 1, during the reception of the standard wave by the radio wave receiver unit 41, the center value of the pass frequency band of the BPF 414 and the intermediate value between the two frequencies adjacent vertically to each other among the harmonic frequencies with respect to the drive waveform frequency of the display unit 45 by the display driver 46 are set so as to be equal to each other. Hence, the frequencies of the electromagnetic noises are spaced farthest from the pass frequency band R1 of the BPF 414, whereby the effect that the electromagnetic noises are mixed into the radio wave received by the radio wave receiver unit 41 can be suppressed to the minimum.

Moreover, in this radio wave timepiece 1, at the time when the standard wave is received by the radio wave receiver unit 41, the frame frequency of the display unit 45, that is, the drive waveform frequency is changed from the frequency of the usual time, whereby the display unit 45 is enabled to perform the display. Accordingly, the drive waveform frequencies suitable to the respective cases where the standard wave is received and otherwise can be set.

In particular, in this radio wave timepiece 1, at the time when the standard wave is received by the radio wave receiver unit 41, the drive waveform frequency of the display unit 45 is set so as to be higher than at the usual time, and otherwise, the power consumption is suppressed without raising the drive waveform frequency more than necessary. Meanwhile, at the time when the standard wave is received, the frequency interval among the harmonics is widened by the drive waveform frequency that is a little higher than usual, whereby the harmonic frequencies can be made to go out of the pass frequency band R1 of the BPF 414 more surely.

Moreover, in this radio wave timepiece 1, the frame frequency to be changed at the time of receiving the standard wave, that is, the drive waveform frequency is prestored in the standard wave reception setting table 44*b* of the ROM 44 in association with the receiving frequency of the standard wave. In such a way, even in the case where the reception is performed while switching the receiving frequencies of the plurality of standard waves, the drive waveform frequency by the display driver 46 can be changed to an appropriate value easily.

Moreover, this radio wave timepiece 1 sets the drive waveform frequency at the time of receiving the standard wave so that the harmonic frequencies of the drive waveform frequency cannot only be included in the pass frequency band R1 of the BPF 414 but also not be superimposed on such a frequency that can lower the sensitivity of the radio wave reception, such as the image frequency and the spurious frequency of the local oscillator 412, whereby the receiving sensitivity to the standard wave can be maintained more stably.

Moreover, at the time of receiving the standard wave, this radio wave timepiece 1 can enable the display, which informs that the standard wave is being received, simultaneously while displaying the time information. Accordingly, this radio wave timepiece 1 does not inhibit the user from obtaining the time information, and can inform the user so as not to move to a position where a state of the radio wave is bad.

Note that the present invention is not limited to the above-described embodiment, and is modifiable in various ways.

For example, in the above-described embodiment, at the time when the standard wave is received, the frame frequency is changed from the usual value, whereby the mixing of the electromagnetic noises is prevented; however, from the first time, the display unit 45 may always be driven by such a frame frequency at which the electromagnetic noises are not mixed into the time code signal.

Moreover, in the above-described embodiment, the frame frequencies are individually set for each of the receiving frequencies of the standard wave by using the standard wave reception table 44*b*; however, one frame frequency may be set, in which the harmonic frequencies are not included in the pass frequency band R1 of the BPF 414 with respect to receiving frequencies of all of such receivable standard waves. By setting the frequency as described above, the display can be continuously performed while simplifying the configuration of the display unit 45.

Moreover, in the above-described embodiment, the processing is performed, which is for allowing the display unit 45 to perform the display to the effect that the standard wave is being received at the time when the standard wave is received; however, the display unit 45 may be allowed to perform the time display as usual without performing any processing as described above.

Moreover, in the above-described embodiment, the description has been made of the digital radio wave timepiece including only the display unit 45, which performs the digital display, as the display unit; however, the present invention is also applicable in a similar way to a radio wave timepiece including both of the digital display unit and an analog display unit by indicator needles.

Besides the above, the specific structure, the arrangement, the control order and the like, which are described in the above-described embodiment, are modifiable as appropriate within the scope without departing from the spirit of the present invention.

The entire disclosure of Japanese Patent Application No. 2011-111017 filed on May 18, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A radio wave timepiece comprising:

a display unit to display a current time in a digital manner;

a display drive unit to drive the display unit by a drive signal of a predetermined drive waveform frequency;

a receiver unit to receive radio waves of a plurality of different frequencies including time information; and a control unit to set the drive waveform frequency during the reception of a radio wave by the receiver unit so that harmonic frequencies with respect to the drive waveform frequencies can be different from a receiving frequency of the radio wave; and wherein the control unit is not set to drive the display based on the harmonic frequencies during non-reception of the radio wave.

2. The radio wave timepiece according to claim 1, wherein, during the reception of the radio wave by the receiver unit, the control unit sets the drive waveform frequency so that the receiving frequency of the radio wave can be equal to an intermediate value between two adjacent frequencies of the harmonic frequencies.

3. The radio wave timepiece according to claim 2, wherein the receiver unit includes a narrow band pass unit that extracts a signal within a predetermined frequency range narrower than a frequency interval in the harmonics of the drive waveform frequencies by selectively passing the signal therethrough, and the control unit sets, during the reception of the radio wave by the receiver unit, the drive waveform frequency so that the harmonic frequencies with respect to the drive waveform frequencies cannot be included in the predetermined frequency range.

4. The radio wave timepiece according to claim 3, wherein, during the reception of the radio wave by the receiver unit, the control unit sets the drive waveform frequency so that a center frequency of the predetermined frequency range can be equal to an intermediate value between two adjacent frequencies of the harmonic frequencies.

5. The radio wave timepiece according to claim 3, wherein, in an event of receiving the radio wave by the receiver unit, no matter which radio wave among radio waves receivable by the receiver unit may be received, the control unit changes the drive waveform frequency to a value in which the harmonic frequencies with respect to the drive waveform frequencies are not included in the predetermined frequency range with respect to a receiving frequency of the radio wave.

6. The radio wave timepiece according to claim 2, wherein, during the reception of the radio wave by the receiver unit, the control unit changes the drive waveform frequency to a frequency different from a frequency at the time when the radio wave is not received.

7. The radio wave timepiece according to claim 6, wherein, during the reception of the radio wave by the receiver unit, the control unit changes the drive waveform frequency to a frequency higher than the frequency at the time when the radio wave is not received.

8. The radio wave timepiece according to claim 2, further comprising: a storage unit that stores receiving frequencies of the receivable radio waves and the drive waveform frequencies set for each of the receiving frequencies in association with each other, wherein, in an event of receiving the radio wave by the receiver unit, the control unit obtains from the storage unit the drive waveform frequency corresponding to the receiving frequency set in the receiver unit, and changes the drive waveform frequency.

9. The radio wave timepiece according to claim 1, wherein the receiver unit includes a narrow band pass unit that extracts a signal within a predetermined frequency range narrower than a frequency interval in the harmonics of the drive waveform frequencies by selectively passing the signal therethrough, and the control unit sets, during the reception of the radio wave by the receiver unit, the drive waveform frequency so that the harmonic frequencies with respect to the drive waveform frequencies cannot be included in the predetermined frequency range.

10. The radio wave timepiece according to claim 9, wherein, during the reception of the radio wave by the receiver unit, the control unit sets the drive waveform frequency so that a center frequency of the predetermined frequency range can be equal to an intermediate value between two adjacent frequencies of the harmonic frequencies.

11. The radio wave timepiece according to claim 10, wherein, in an event of receiving the radio wave by the receiver unit, no matter which radio wave among radio waves receivable by the receiver unit may be received, the control unit changes the drive waveform frequency to a value in which the harmonic frequencies with respect to the drive waveform frequencies are not included in the predetermined frequency range with respect to a receiving frequency of the radio wave.

12. The radio wave timepiece according to claim 9, wherein, during the reception of the radio wave by the receiver unit, the control unit changes the drive waveform frequency to a frequency different from a frequency at the time when the radio wave is not received.

13. The radio wave timepiece according to claim 12, wherein, during the reception of the radio wave by the receiver unit, the control unit changes the drive waveform frequency to a frequency higher than the frequency at the time when the radio wave is not received.

14. The radio wave timepiece according to claim 9, further comprising: a storage unit that stores receiving frequencies of the receivable radio waves and the drive waveform frequencies set for each of the receiving frequencies in association with each other, wherein, in an event of receiving the radio wave by the receiver unit, the control unit obtains from the storage unit the drive waveform frequency corresponding to the receiving frequency set in the receiver unit, and changes the drive waveform frequency.

15. The radio wave timepiece according to claim 9, wherein, in an event of receiving the radio wave by the receiver unit, no matter which radio wave among radio waves receivable by the receiver unit may be received, the control unit changes the drive waveform frequency to a value in which the harmonic frequencies with respect to the drive waveform frequencies are not included in the predetermined frequency range with respect to a receiving frequency of the radio wave.

16. The radio wave timepiece according to claim 1, wherein, during the reception of the radio wave by the receiver unit, the control unit changes the drive waveform frequency to a frequency different from a frequency at the time when the radio wave is not received.

17. The radio wave timepiece according to claim 16, wherein, during the reception of the radio wave by the receiver unit, the control unit changes the drive waveform frequency to a frequency higher than the frequency at the time when the radio wave is not received.

18. The radio wave timepiece according to claim 1, further comprising: a storage unit to store receiving frequencies of the receivable radio waves and the drive waveform frequencies set for each of the receiving frequencies in association with each other, wherein, in an event of receiving the radio wave by the receiver unit, the control unit obtains from the storage unit the drive waveform frequency corresponding to the receiving frequency set in the receiver unit, and changes the drive waveform frequency.

19. The radio wave timepiece according to claim 1, wherein the receiver unit includes a receiving circuit using a heterodyne method, and during the reception of the radio wave by the receiver unit, the control unit sets the drive waveform frequencies so that the harmonic frequencies with respect to the drive waveform frequencies can be different from an image frequency in the receiver unit.

20. The radio wave timepiece according to claim 1, further comprising:

a display control unit to allow the display unit to perform display showing that the radio wave is being received, during the reception of the radio wave by the receiver unit.

* * * * *